United States Patent [19]

Gotoh

[11] Patent Number: 4,537,226

[45] Date of Patent: Aug. 27, 1985

[54] SYSTEM FOR CONTROLLING WARP LET-OFF MOTION OF WEAVING MACHINE DURING MACHINE DOWNTIME

[75] Inventor: Miyuki Gotoh, Machida, Japan

[73] Assignee: Nissan Motor Co., Ltd., Yokohama, Japan

[21] Appl. No.: 534,387

[22] Filed: Sep. 21, 1983

[30] Foreign Application Priority Data

Sep. 24, 1982 [JP] Japan ..... 57-166319

[51] Int. Cl.[3] ..... D03D 49/06; D03D 51/00

[52] U.S. Cl. ..... 139/100; 139/1 E; 139/110

[58] Field of Search ..... 139/100, 97, 109, 110, 139/1 E, 336, 105–108; 66/209, 210

[56] References Cited

U.S. PATENT DOCUMENTS

| | | | |
|---|---|---|---|
| 4,224,967 | 9/1980 | Tagawa | 139/108 |
| 4,364,002 | 12/1982 | Suzuki et al. | 139/1 E |
| 4,411,293 | 10/1983 | Santucci | 139/110 |
| 4,458,728 | 7/1984 | Rotrekl et al. | 139/110 |

FOREIGN PATENT DOCUMENTS

| | | | |
|---|---|---|---|
| 45-37180 | 11/1970 | Japan | 139/110 |
| 56-68140 | 6/1981 | Japan | 139/110 |
| 724611 | 3/1980 | U.S.S.R. | 139/1 E |

*Primary Examiner*—James Kee Chi

*Attorney, Agent, or Firm*—Schwartz, Jeffery, Schwaab, Mack, Blumenthal & Evans

[57] ABSTRACT

A weaving machine has a first drive means which has a speed change transmission and drives a warp beam during normal weaving operation, and a second drive means for driving the warp beam independently of the first drive means when the weaving machine is moved by inching or by hand during downtime operation. A first sensor senses the weaving cycle of the weaving machine, and a second sensor senses the warp beam rotation. A warp beam rotation control system determines the angular displacement of the warp beam per weaving cycle during normal weaving operation, and controls the warp beam rotation during downtime operation in accordance with the determined angular displacement per weaving cycle.

20 Claims, 14 Drawing Figures

SYSTEM FOR CONTROLLING WARP LET-OFF MOTION OF WEAVING MACHINE DURING MACHINE DOWNTIME

BACKGROUND OF THE INVENTION

The present invention relates to a system for controlling a warp let-off motion of a loom during downtimes, that is, a system for controlling the rotational movement of a warp beam when the loom is not in a normal weaving operation but moved by inching or by hand in a forward or reverse direction.

Let-off motions of looms, especially of a fluid jet type which is operated at high speeds, are usually provided with stepless speed change devices to guarantee a uniform warp tension from full to empty warp beam. One example of such stepless speed change devices is disclosed in Japanese patent examined publication No. 45-37180.

In this stepless speed change device, rotational movement of an input shaft is converted to movement of link means, and then the movement of the link means is converted again to rotational movement of an output shaft by the aid of a one-way clutch disposed between the link means and the output shaft. Therefore, the output shaft is rotated only in one direction whether the input shaft is rotated in forward direction or reverse direction.

If a malfunction such as a mispick is found during weaving operation, a loom in trouble is stopped for mending. However, a mispick is usually detected at a beating step following a weft inserting step especially in high speed jet looms, and there is a delay in subsequent response due to a time lag of a control circuit and/or delay in braking action. For these reasons, it is usual that a loom actually stops at the next weft-inserting step. Therefore, in order to remove a wrongly-inserted weft, it is necessary to rotate the loom in the reverse direction. In this case, the reverse rotation of the loom causes a reverae rotation of a woven fabric take-up motion because the take-up motion is connected with a driving shaft of the loom by a gear train. At the same time the reverse rotation of the loom causes a warp let-off motion to rotate in a forward direction because the let-off motion has a stepless speed change device of the above mentioned type. By these movements of the take-up motion and the let-off motion, the cloth fell is moved out of position, so that it is necessary to set the cloth fell in position again to restart the loom. Such a setting operation is necessary for preventing an undesired mark which is formed in the fabric at the position of the cloth fell when the weaving operation is restarted. However, this setting operation requires skill, and accordingly there is a strong demand for an automatic mechanism for doing such a setting operation automatically.

To meet this problem, Japanese patent provisional publication No. 56-68140 discloses a warp let-off mechanism which is provided with means for reversing the direction of output shaft rotation of a stepless speed change device in accordance with the direction of the loom rotation. However, this mechanism utilizes a worm gear, so that it requires a force increased by one and a half times to obtain the reverse rotation. Accordingly the construction of the stepless speed change device must be made strong enough to endure such an increased force, with the result of an increase of the manufacturing cost.

SUMMARY OF THE INVENTION

It is an object of the present invention to provide a weaving system which can control the relation between the weaving machine movement and the warp beam rotational movement when the weaving machine is moved by inching or by hand during downtime.

It is an object of the present invention to provide a weaving system which can automatically set the cloth fell at a correct position to restart the weaving operation in the case the weaving machine is moved in the reverse direction by inching or by hand during downtime.

According to the present invention, a weaving system comprises a warp beam and a main mechanism which is combined with the warp beam, and moves periodically so as to repeat a weaving cycle. "Main weaving mechanism" as used herein and in the appended claims is intended to mean the balance of a weaving apparatus apart from the warp beam proper and its attendant driving and control mechanisms. Thus, the main weaving mechanism normally comprises a shedding mechanism, a picking mechanism, and a beat-up mechanism. The main mechanism has a normal weaving operation mode and a slow operation mode. The weaving system further comprises a driving shaft which is driven in synchronism with the periodical movement of the main mechanism, and first and second drive means. The first drive means drives the warp beam in the normal operation mode by transmitting power from the driving shaft to the warp beam. The first drive means includes speed change means capable of changing the speed of the warp beam rotation. The first drive means further includes first clutch means for connecting and disconnecting the driving connection between the driving shaft and the warp beam through the first drive means. The second drive means drives the warp beam in the slow operation mode by transmitting power from the driving shaft to the warp beam independently of the first drive means. The second drive means includes second clutch means for connecting and disconnecting the driving connection between the driving shaft and the warp beam through the second drive means. The weaving system further comprises first sensing means, second sensing means, and control means. The first sensing means senses the periodical movement of the main mechanism, and the second sensing means senses the rotational movement of the warp beam. The control means is connected with the first and second sensing means. The control means determines, during the normal operation mode, a quantity indicative of an angular displacement of the warp beam per weaving cycle in accordance with signals produced by the first and second sensing means. The control means stores the determined value of the quantity, and controls the warp beam rotation during the slow operation mode by controlling the second clutch means in such a manner that the warp beam rotates only through an angle equal to the stored value when the main mechanism is moved through one weaving cycle during the slow operation mode.

DETAILED DESCRIPTION OF THE INVENTION

Figure 1:
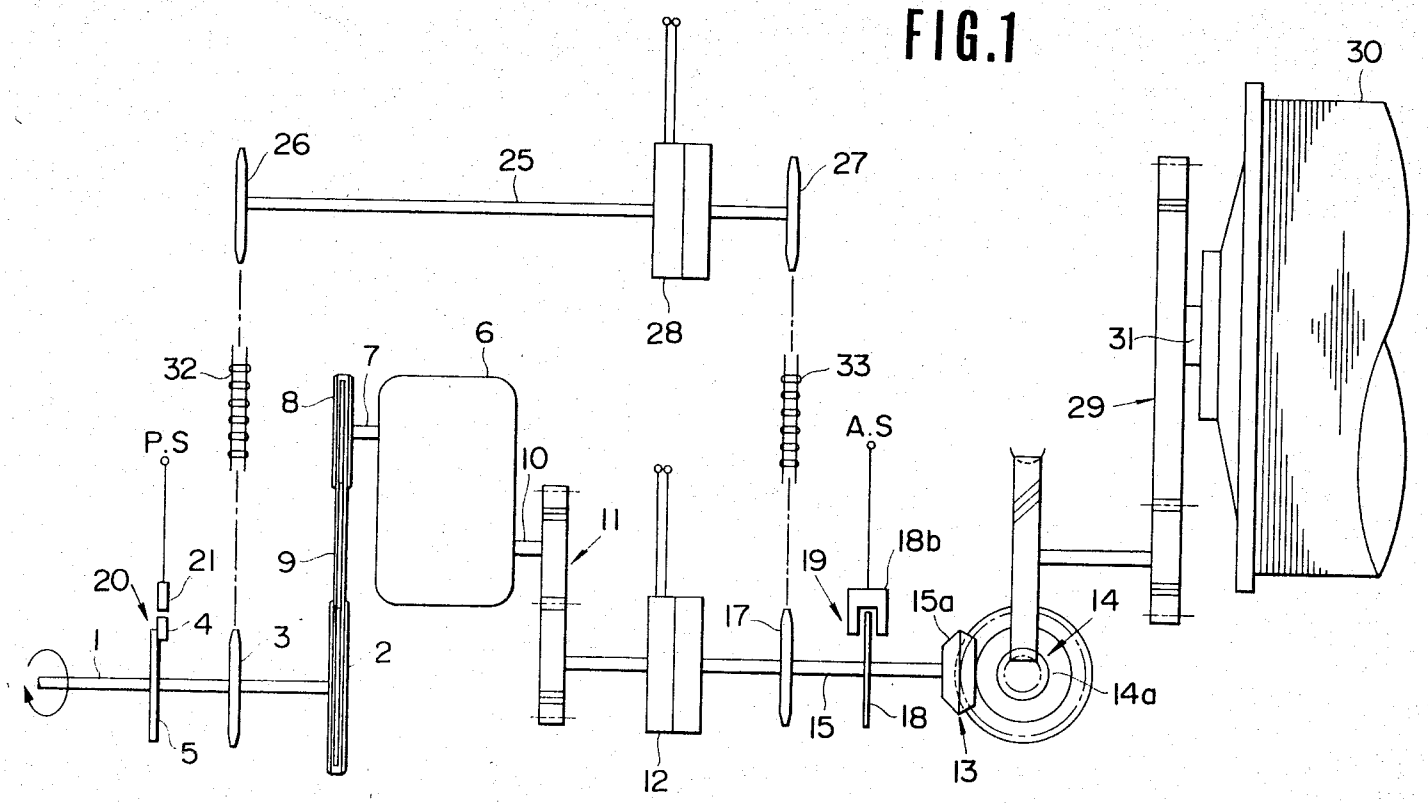
FIG. 1 is a schematic illustration showing a mechanism for driving a warp beam, according to the present invention.

One embodiment of the present invention is shown in FIGS. 1 to 5. An input shaft 1 rotates in synchronism with a reed of the loom. That is, the input shaft 1 rotates by one revolution each time the reed completes one beating step. A V-belt pulley 2 is fixedly mounted on one end of the input shaft 1. A chain sprocket wheel 3 is fixedly mounted on an intermediate portion of the input shaft 1. An arm 5 having an iron piece 4 is fixed to the intermediate portion of the input shaft 1. A proximity switch 21 is disposed so as to face the iron piece 4 when the arm 5 is in a predetermined angular position. The arm 5, the iron piece 4 and the proximity switch 21 constitute a reference rotation detecting means 20. A stepless speed change transmission 6 has an input shaft 7 driven by the input shaft 1. A V-belt pulley 8 is fixedly mounted on the input shaft 7 of the stepless speed change transmission 6. The V-belt pulleys 2 and 8 are drivingly connected together by a V-belt 9. An output shaft 10 of the stepless speed change transmission 6 is connected to a first electromagnetic clutch 12 through gears 11. The first electromagnetic clutch 12 is connected to one end of an output shaft 15. A bevel gear 15*a* of a bevel gearing 13 is fixedly mounted on the other end of the output shaft 15. The output shaft 15 has a chain sprocket wheel 17 and a rotary disc 18*a* which are fixed thereto between both ends. The rotary disc 18*a* is a component member of an encoder 18 which is a means 19 for detecting warp beam rotation. The rotary disc 18*a* is formed with a plurality of slits arranged circumferentially along the periphery. The number of the slits of the rotary disc 18*a* amounts to 2000, for example. A detector 18*b* of the encoder 18 detects the slits of the rotary disc 18*a* one by one. The bevel gearing 13 is in direct contact with a worm gearing 14 to transmit driving torque. The worm gearing 14 has a worm 14*a*. The worm gearing 14 drives a shaft 31 of a warp beam 30 through gears 29. There is further provided a secondary shaft 25, which is in parallel with the input shaft 1 and the output shaft 15. One end of the secondary shaft 25 has a chain sprocket wheel 26 fixed thereto, and the other end of the secondary shaft 25 has a chain sprocket wheel 27 fixed thereto. The secondary shaft 25 has a second electromagnetic clutch 28 disposed between the chain sprocket wheels 26 and 27. The chain sprocket wheel 26 is drivingly connected with the chain sprocket 3 by an endless chain 32. The chain sprocket wheel 27 is drivingly connected with the chain sprocket wheel 17 by a chain 33.

During the normal weaving operation, the rotational movement of the input shaft 1 is transmitted to the warp beam 30 to rotate warp beam 30 in the same direction by way of the V-belt 9, the stepless speed change transmission 6, the gears 11, the first electromagnetic clutch 12, the output shaft 15, the bevel gearing 13, the worm gearing 14, the gears 29. During this, the stepless speed change transmission 6 changes the rotational speed of the input shaft 1 to such a speed as to provide an optimum warp letting off rate. In addition to this line for transmitting driving torque from the input shaft 1 to the warp beam, there is provided a secondary line through which driving torque can be transmitted from the input shaft 1 to the warp beam 30 without passing through the stepless speed change transmission 6. In this secondary line, driving torque is transmitted by way of the chain 32, the secondary shaft 25, the second electromagnetic clutch 28, the chain 33, and the output shaft 15. This secondary line is used when the weaving machine is stopped.

Figure 2:
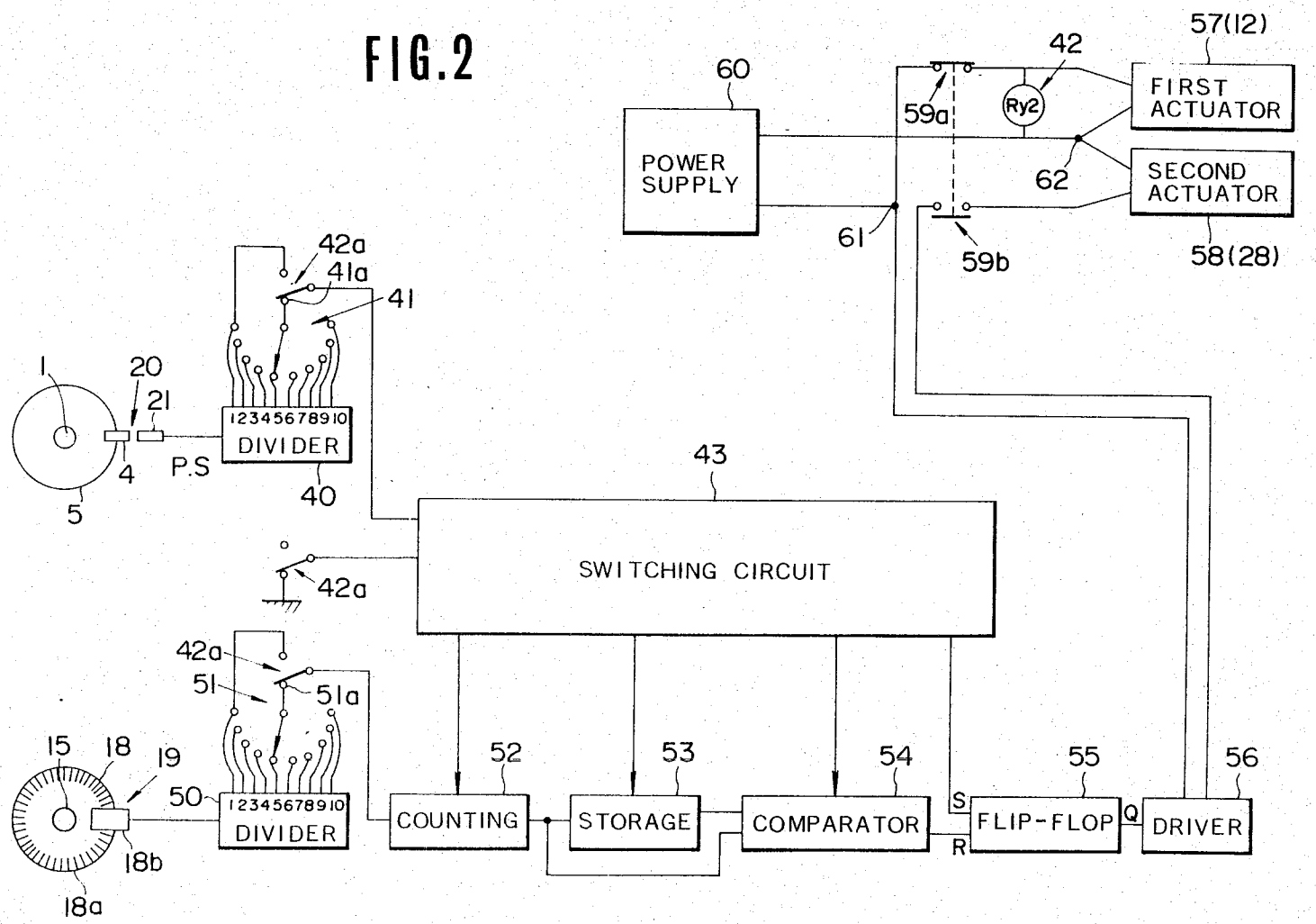
FIGS. 2 and 3 are schematic block diagrams showing a warp beam rotation control system of the present invention.

A control circuit is shown in FIG. 2. The proximity switch 21 is connected to a first divider circuit 40 so that the first divider circuit 40 receives an output signal of the proximity switch 21. The detector 18*b* of the encoder 18 is connected to a second divider circuit 50 so that the second divider circuit 50 receives an output signal of the detector 18*b*. The first divider circuit 40 is connected to a switching circuit 43 through a rotary switch 41 and a movable contact 42*a* of a second relay 42. An output signal of the first divider circuit 40 is inputted to the switching circuit 43 through the rotary switch 41 and the movable contact 42*a*. The second divider circuit 50 is connected to a counting circuit 52 through a rotary switch 51 and a movable contact 42*a* of the second relay 42. Thus, an output signal of the second divider circuit 50 is inputted to the counting circuit 52 through the rotary switch 51 and the contact 42*a*. The counting circuit 52 is connected to a storage circuit 53 and a comparator circuit 54 so that an output signal of the counting circuit 52 is sent to the storage circuit 53 and the comparator circuit 54. The storage circuit 53 is connected to the comparator circuit 54 so that the comparator circuit 54 further receives an output signal of the storage circuit 53. An output signal of the comparator circuit 54 is inputted to a reset terminal R of a flip-flop circuit 55. The switching circuit 43 is connected to a set terminal S of the flip-flop circuit 55. The switching circuit 43 is further connected to the counting circuit 52, the storage circuit 53, and the comparator circuit 54, individually. Each of these circuits 52, 53, 54 and 55 receives a signal from the switching circuit 43. An output terminal Q of the flip-flop circuit 55 is connected to a driver circuit 56 so that an output signal of the flip-flop circuit 55 is supplied to the driver circuit 56.

The driver circuit 56 is connected to first and second contacts 59*a* and 59*b* of a first relay (not shown). The second relay 42 is connected in parallel with a first actuating circuit 57 for actuating the first electromagnetic clutch 12. The driver circuit 56 is connected in series with a second actuating circuit 58 for actuating the second electromagnetic clutch 28, through the second contact 59*b*. The parallel combination of the relay 42 and the first actuating circuit 57 is connected to a junction point 61 through the first contact 59*a*, and to a junction point 62 so that this parallel combination is interposed between the junction points 61 and 62. The series combination of the driver circuit 56 and the second actuating circuit 58 is interposed between the same pair of the junction points 61 and 62, so that the parallel combination 42 and 57 and the series combination 56 and 58 are in parallel. One terminal of a power source 60 is connected to the junction point 61, and the other terminal is connected to the junction point 62.

When a main switch (not shown) of the weaving machine is turned on to start the manual weaving operation, the first relay (not shown) closes the first contact 59*a* and opens the second contact 59*b*. Accordingly, the second relay 42 becomes operative and connects the contacts 42*a* with the terminals 41*a* and 51*a* of the rotary switches 41 and 51, respectively, as shown in FIG. 2 which shows the state of the normal weaving operation.

The proximity switch 21 produces a P.S. (proximity switch) signal indicative of the weaving cycle of the loom. That is, the proximity switch 21 produces a pulse each time the loom repeats one weaving cycle. The first divider circuit 40 divides the pulse repetition frequency of the P.S. signal of the proximity switch 21 by a predetermined number. In this embodiment, the predetermined number is five. That is, the first divider circuit 40 allows one pulse to pass therethrough each time the first divider circuit 40 receives five pulses. The first divider circuit 40 is helpful for improving the accuracy of the control. However, it is not necessary to use the first divider circuit 40. The pulses allowed to pass through the first divider circuit 40 are supplied to the switching circuit 43 through the rotary switch 41 and the contact 42*a* of the second relay 42. The switching circuit 43 sends signals to the counting circuit 52, the storage circuit 53, the comparator circuit 54 and the flip-flop circuit 55 each time the switching circuit 43 receives one pulse from the first divider circuit 40.

While the loom is running, the detector 18*b* of the encoder 18 produces an A.S. (angular sensor) signal consisting of pulses indicative of the angular displacement of the output shaft 15. The second divider circuit 50 divides the pulse repetition frequency of the pulse train sent from the detector 18*b* by a predetermined number. In this embodiment, the predetermined number is five. That is, the second divider circuit 50 allows one pulse to pass therethrough each time it receives five pulses. The pulses sent from the second divider circuit 50 are supplied to the counting circuit 52 through the rotary switch 51 and the contact 42*a* of the second relay 42. The counting circuit 52 counts the number of the pulses received during the interval between two consecutive pulses of the P.S signal. That is, the counting circuit 52 is reset to zero to start the counting again, by the switching circuit 43 each time the switching circuit 43 receives one pulse from the first divider circuit 40. The storage circuit 53 stores the count of the counting circuit 52. Upon each receipt of a pulse from the first divider circuit 40, the switching circuit 43 sends signals to the counting circuit and the storage circuit 53, commands the counting circuit 52 to transfer the count to the storage circuit 53 before resetting the counting circuit 52, and commands the storage circuit 53 to store the newly-transferred count in place of the old count already stored. Accordingly, the storage circuit 53 always stores the newest information of the count. During this normal weaving operation, the first electromagnetic clutch 12 is engaged, and the second electromagnetic clutch 28 is disengaged, so that the warp let-off mechanism drives the warp beam through the stepless speed change transmission 6 in the normal manner.

Figure 3:
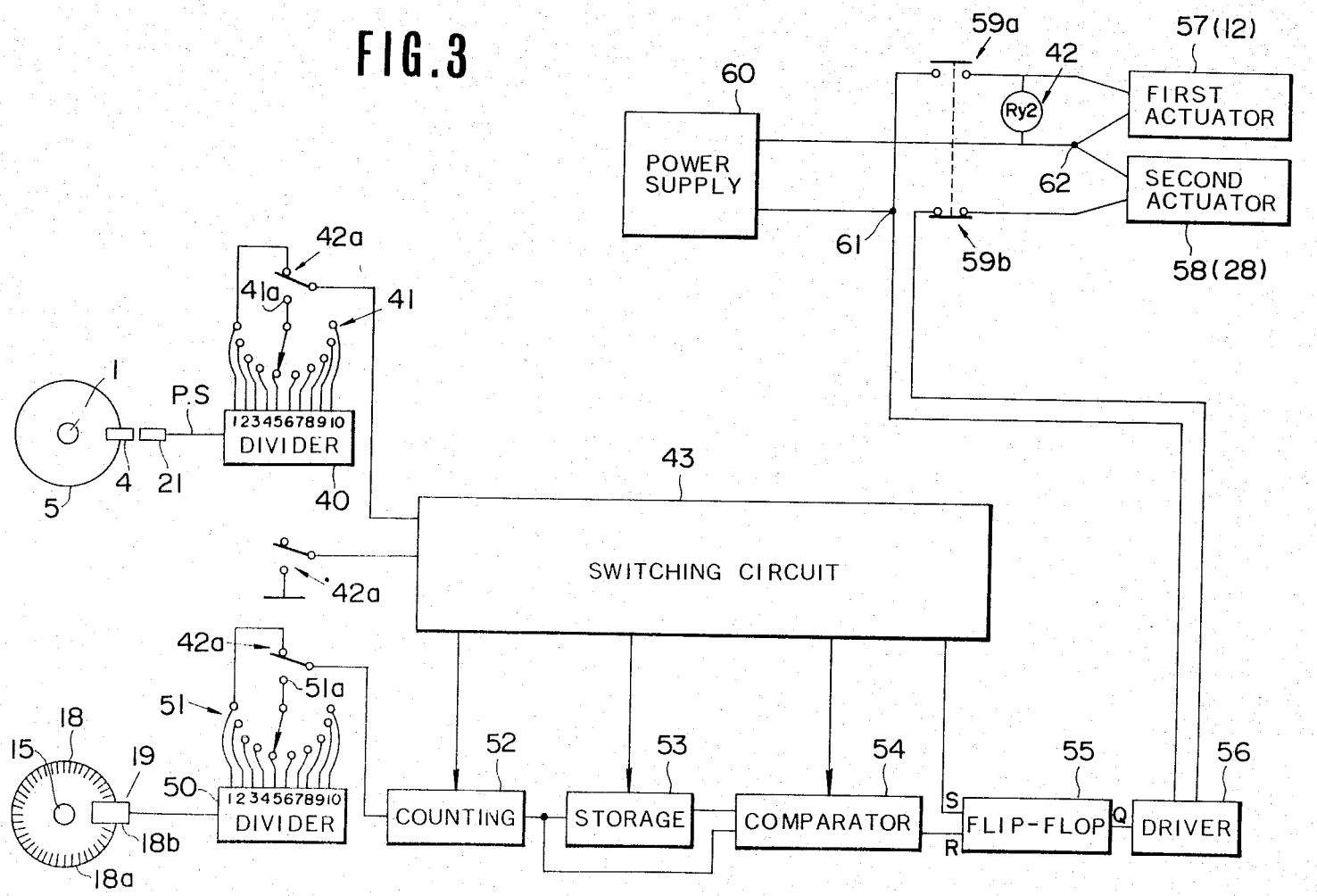
Figure 4:
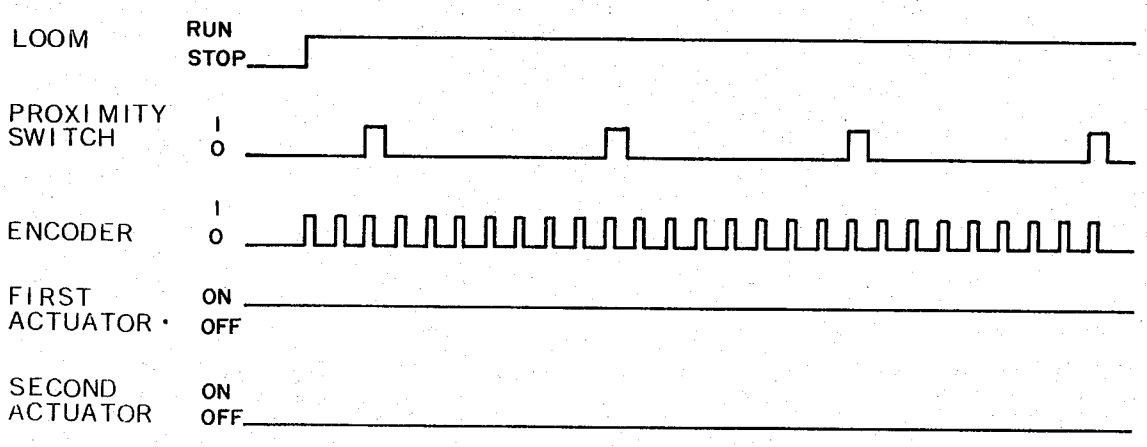
FIGS. 4 and 5 are timing charts showing the operations of the warp beam rotation control system shown in FIGS. 2 and 3.
Figure 5:
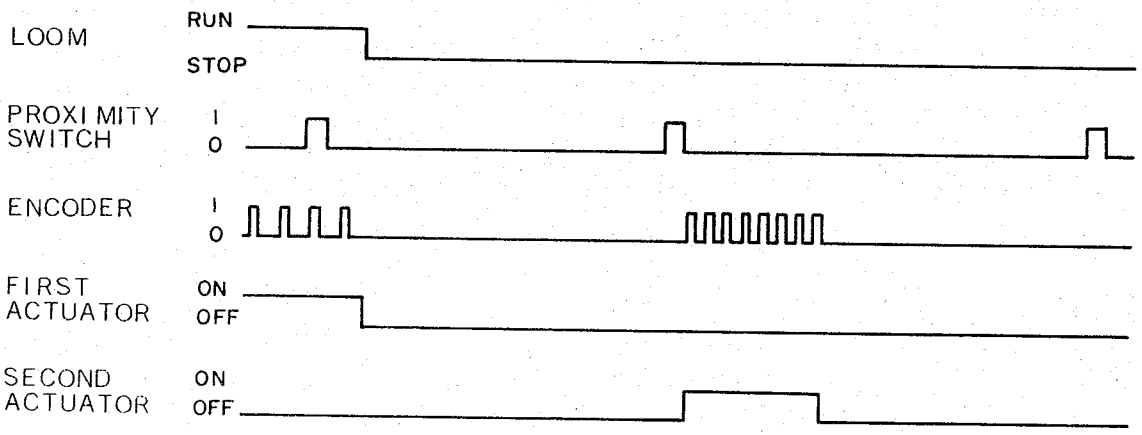
Figure 6:
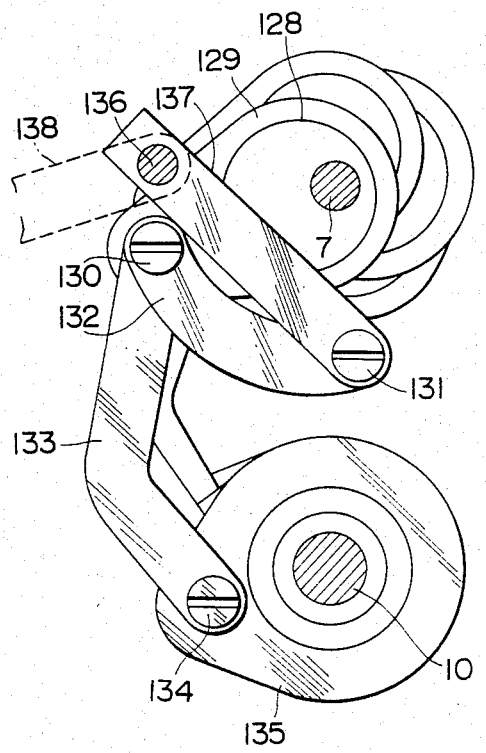
FIG. 6 is a fragmentary side view of a speed change transmission of a warp let-off mechanism.

When the main switch of the loom is turned off, and the loom is stopped, the first relay (not shown) is deenergized, so that the first contact 59*a* is opened, and the second contact 59*b* is closed, as shown in FIG. 3. Because the first contact 59*a* is opened, the first actuating circuit 57 is deenergized, and the first electromagnetic clutch 12 is disengaged. At the same time, the second relay 42 is deenergized, so that the contacts 42*a* of the second relay 42 are disconnected from the terminals 41*a* and 51*a*, and instead connected with the "one" terminal of the first and second divider circuits 40 and 50, respectively. Although the second contact 59*b* is closed in this state, the second actuating circuit 58 is not energized, and the second electromagnetic clutch 28 is not engaged until the driver circuit 56 makes the connection between the second actuating circuit 58 and the power source 60. The driver circuit 56 does not make the connection between the second actuating circuit 58 and the power source 60 until a pulse is supplied from the first divider circuit 50 to the switching circuit 43. The storage circuit 53 stores the count counted by the counting circuit 52 just before the loom is stopped, and maintains the then-stored count unchanged.

If the loom is moved in the forward direction or in the reverse direction, by inching or by hand, the proximity switch 21 and the detector 18*b* of the encoder 18 supply pulses to the first and second divider circuits 40 and 50, respectively. The thus-supplied pulses can pass through the "one" terminals which allow free passage of pulses. Thus, the first and second divider circuits 40 and 50 do not perform their dividing functions. Accordingly, the counting circuit 52 counts the number of pulses produced by the encoder 18 during an interval required for one revolution of the input shaft 1. The thus-obtained count bypasses the storage circuit 53, and is sent to the comparator circuit 54. The storage circuit 53 is not set, so that it maintains the count counted just before the loom is stopped. The comparator circuit 54 supplies its signal to the reset terminal R of the flip flop circuit 55 when the count of the counting circuit 52 becomes equal to the stored count of the storage circuit 53. The switching circuit 43 supplies its signal to the set terminal of the flip flop circuit 55 each time the switching circuit receives the pulse of the proximity switch 20. When the signal is applied to the set terminal of the flip flop circuit 55, the output of the Q terminal becomes "1". When the signal is applied to the reset terminal R of the flip flop circuit 55, the output at the Q terminal becomes "0". When the output at the Q terminal of the flip flop circuit is "one", the driver circuit 56 makes the connection between the power source 60 and the second actuating circuit 58. When the output at the Q terminal of the flip flop circuit 55 is "zero", the driver circuit 56 breaks the connection between the power source 60 and the second actuating circuit 58.

Thus, the warp beam 30 is driven through the secondary shaft 25 and the second electromagnetic clutch 28 when the loom is moved by inching or by hand while the main switch remains in its off state. In this case, the driver circuit 56 allows the warp beam 30 to rotate in a warp let-off direction or in a reverse direction through an angle corresponding to an angular displacement of the warp beam per weaving cycle, measured just before the loom is stopped. If the loom is moved through two weaving cycles in the reverse direction, this system repeats the above-mentioned process two times. In this case, the switching circuit 43 supplies its signal to the comparator circuit 54 and sets the comparator circuit 54 to an initial state to restart the comparison.

Thus, this system can provide an accurate control of the warp beam rotation, and prevent an undesired mark of the woven fabric due to a loom stoppage.

If it is desired to differentiate the angular displacement of the warp beam per weaving cycle between the normal operation and the downtime operation, this can be done by the first and second divider circuits. For example, the output of the first divider circuit 40 can be set at "four". That is, the first divider circuit 40 will output one pulse each time it receives four pulses, and the second divider circuit 50 outputs one pulse each time it receives five pulses. In this case, the warp beam angular displacement per weaving cycle of the downtime operation is reduced by 20% as compared with that of the normal operation. Thus, this system can provide a warp beam rotation control adapted to the kind of the fabric.

One example of the stepless speed change transmission 6 is shown in FIGS. 6 to 11. An input shaft 7 has a plurality of eccentric inner discs 128, which are fastened eccentrically around the input shaft 7 and rotatable with the input shaft 1. Each of the eccentric inner discs 128 rotates in an eccentric outer ring 129. Each of the eccentric outer rings 129 has a lobe which is swingably connected by a pin 130 to one end of a control arm 132 and one end of a connecting arm 133. The other end of each of the control arms 132 is swingably connected to a common shaft 131. The other end of each of the connecting arms 133 is connected to a lobe of a driven ring 135 by a pin 134. When the input shaft 7 rotates in either of the forward and reverse directions, the control arms 132 swings on the common shaft 131, and the connecting arms 133 move in a reciprocating manner irrespective of whether the direction of the rotation of the input shaft 7 is forward or reverse. Thus, the forward and reverse rotations of the input shaft 7 is converted to reciprocating angular movement of the driven rings 135.

The common shaft 131 is rotatably supported on a yoke 137, which is connected to a shaft 136. The shaft 136 is rotatably supported on a transmission case 140. A speed change lever 138 is fastened to the shaft 136. The position of the common shaft 131 can be changed by shifting the speed change lever 138. In accordance with the position of the common shaft 131 on which the control arms 132 swings, the stroke of the reciprocating motion of the connecting arms 133 is changed, so that the degree of the reciprocating angular movement of the driven rings 135 can be changed.

Figure 12:
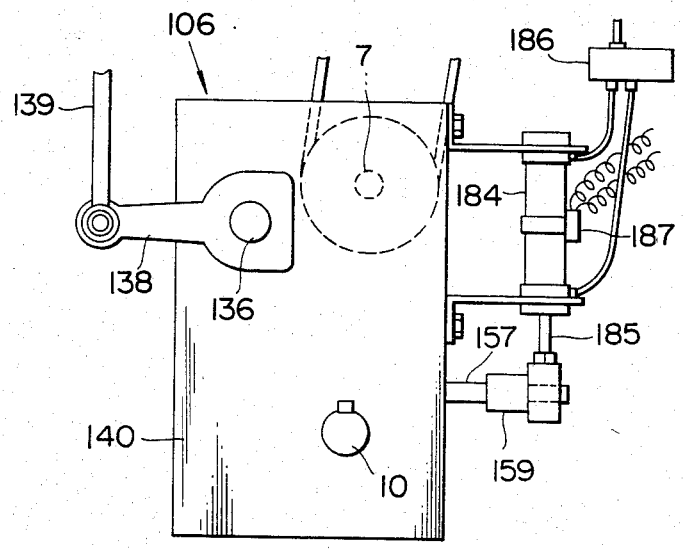
FIG. 12 is a side view of the speed change transmission of FIG. 6.
Figure 13:
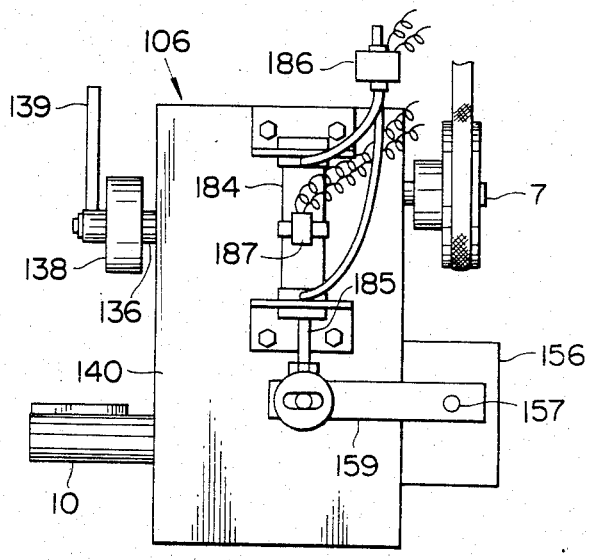
FIG. 13 is a front view of the speed change transmission of FIG. 6.

The speed change lever 138 is connected, through a rod 139 as shown in FIGS. 12 and 13, to a tension lever of a warp tension detector (not shown) so that the speed change lever 138 is shifted in accordance with warp tension.

Figure 7:
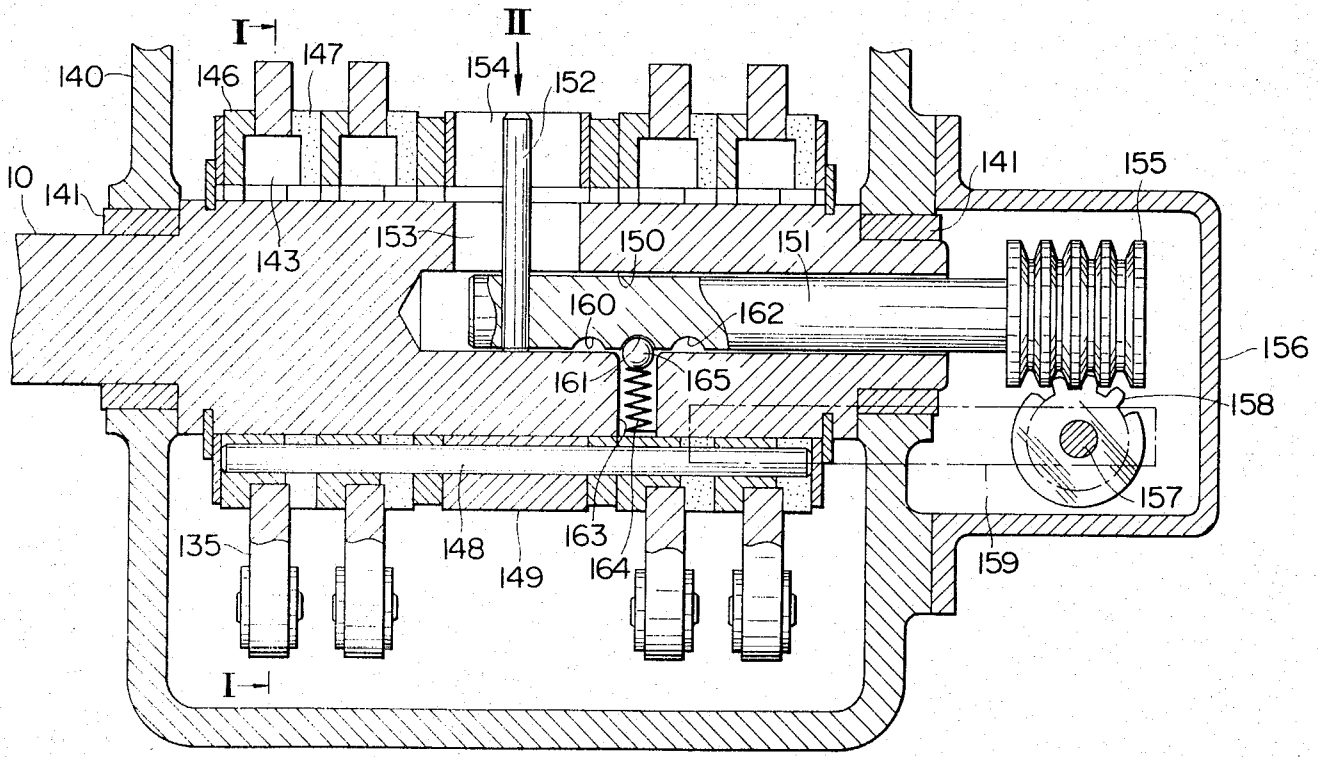
FIG. 7 is a fragmentary sectional front view of the speed change transmission of FIG. 6.
Figure 8:
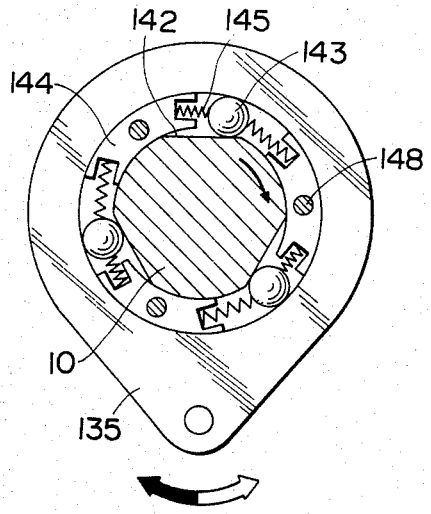
FIGS. 8, 9 and 10 are sectional views taken along a line I—I of FIG. 7.

As shown in FIG. 7, the output shaft 10 is rotatably supported on side walls of the transmission case 140 through bearings 141. Each of the driven rings 135 is mounted on the output shaft 10 through a one-way clutch, as shown in FIG. 8.

For each of the driven rings 135, the output shaft 10 is formed with a set of recesses 142 which are arranged circumferentially around the periphery at regular intervals. Each recess 142 has a roller 143 which is disposed between the bottom of the recess 142 and the driven ring 135. There are provided arc members 144 each of which is interposed between a neighboring pair of the rollers 143. Each of the arc members 144 is disposed slidably between the outer surface of the output shaft 10 and the inner surface of the driven ring 135. A spring 145 is disposed between each neighboring pair of the roller 143 and the arc member 144. Each of the driven rings 135 is sandwiched between cover rings 146 and 147 which cover the annular space formed between the output shaft 10 and the driven ring 135. Each of the arc members 144 is rotatable relative to the output shaft 10, and integral with one of the cover ring 146 and 147.

The arc members 144 and the cover rings 146, 147 are integrated into a single unit by common shafts 148 which pass through these members. The common shafts 148 are supported by a shift ring 149 which is rotatably mounted on the output shaft 10.

Figure 11:
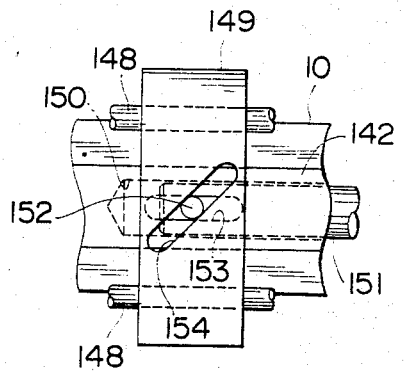
FIG. 11 is a fragmentary view taken in a direction shown by an arrow II in FIG. 7.

The output shaft 10 is formed with a guide hole 150 which extends along the axis of the output shaft 10. A shift rod 151 is inserted into and slidable in the guide hole 150 of the output shaft 10. A radially extending pin 152 is fixed to an inner end of the shift rod 151. The output shaft 10 is further formed with an axially elongated slot 153 which extends radially from the guide hole 150 and opens to the outside. The pin 152 passes radially through the slot 153, so that the output shaft 10 and the shift rod 151 rotate together. The shift ring 149 is formed with a slant slot 154 which is elongated obliquely as shown in FIG. 11. The pin 152 passes radially through the slant slot 154 of the shift ring 149. Therefore, when the shift rod 151 moves axially, the shift ring 149 is compelled to rotate relative to the output shaft 10.

The shift rod 151 projects axially out of the guide hole 150. An outer end of the shift rod 151 is integrally formed with a cylindrical rack 155. The cylindrical rack 155 is engaged with a pinion 158 fixedly mounted on a shaft 157 which is supported on a case 156. The shaft 157 is connected to a reversing lever 159. The shift rod 151 can be axially moved by operating the reversing lever 159. The shift rod 151 is formed with three recesses 160, 161 and 162 which are axially aligned. The output shaft 10 is formed with a radial hole 163, which contains a spring 164 and a lock ball 165. The lock ball 165 can engage with any one of the recesses 160, 161 and 162.

When the reversing lever 159 is turned in clockwise direction as viewed in FIG. 7, the cylindrical rack 155 and the pinion 158 cooperate to move the shift rod 151 rightward in FIG. 7 into a forward position in which position the lock ball 65 engages with the recess 160. During this, the pin 152 moves rightward as viewed in FIG. 11, and by so doing, causes the shift ring 149 to rotate relative to the output shaft 10 with the help of the slant slot 154. Consequently, the arc members 144 rotate in clockwise direction as shown in FIG. 8 with respect to the output shaft 10, because the arc members 144 are integral with the shift ring 149 through the common shafts 148. Thus, the rollers 143 are pushed in clockwise direction by the arc members 144 as shown in FIG. 8.

In this state, only the clockwise rotational movement of the driven rings 135, as viewed in FIG. 8, is transmitted to the output shaft 10 through the roller 143, while the driven rings 35 moves back and forth rotationally. Therefore, the output shaft 10 rotates intermittently in a clockwise direction as viewed in FIG. 8. This direction of the output shaft rotation is a forward direction, that is, a warp letting off direction.

Figure 9:
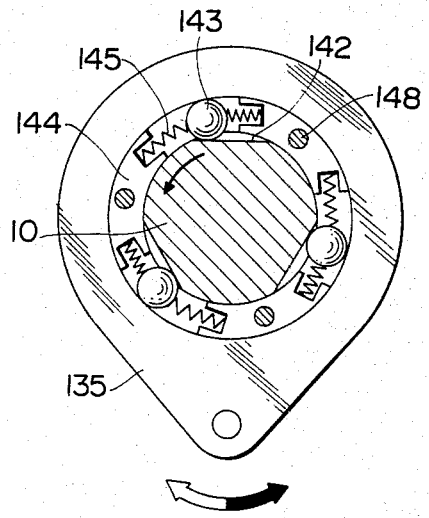
Figure 10:
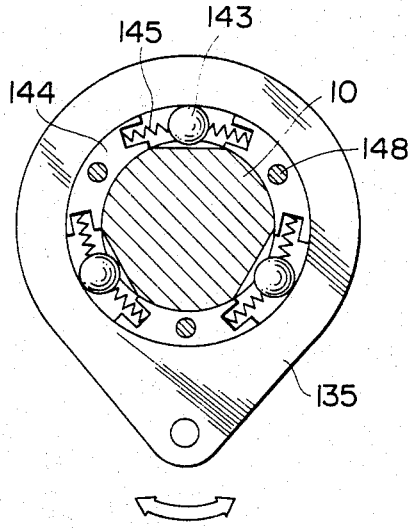

When the reversing lever 159 is turned in a counterclockwise direction as viewed in FIG. 7, the shift rod 151 moves leftward as viewed in FIG. 7 by the action of the cylindrical rack 155 and the pinion 158, and the lock ball 165 is received in the recess 162. With this linear movement of the shift rod 151, the pin 152 moves leftward as viewed in FIG. 11, and the shift ring 149 rotates with respect to the output shaft 10 with the help of the slant slot 154. Thus, the arc members 144 rotate integrally with the shift ring 149 in a counterclockwise direction as shown in FIG. 9 with respect to the output shaft 10, and push the roller 143 in the same direction.

In this state, only the counterclockwise rotation of the driven rings 135 is transmitted to the output shaft 10 through the rollers 143 while the driven rings 135 moves back and fourth rotationally. Thus, the output shaft rotates intermittently in a counterclockwise direction as viewed in FIG. 9, which is a reverse direction opposite to the forward direction.

When the reversing lever 159 is in an intermediate position as shown in FIG. 7, the shift rod 151 is in an idle position in which position the lock ball 165 engages with the recess 161 lying between the recesses 160 and 162. Thus, the arc members 144 move, through the action of the pin 152, the shift ring 149 and the common shafts 148, into a position shown in FIG. 10, relative to the output shaft 10. In this position, each of the rollers is in the middle of the recess 142 and has play.

In this state, neither of the clockwise and counterclockwise rotations of the driven rings 135 is transmitted to the output shaft. Thus, the driven rings move back and forth rotationally, but the output shaft 10 does not rotate.

Thus, the stepless speed change transmission has three positions, a forward position in which the output shaft rotates in the forward direction irrespective of the direction of the input shaft rotation, a reverse position in which the output shaft rotates in the reverse direction irrespective of the direction of the input shaft rotation, and an idle position in which the output shaft is not driven. The ratio of input speed to output speed is changed in accordance with the tension of the warp threads.

The reversing lever 159 of the stepless speed change transmission 106 is connected to a piston rod 185 of a double acting air cylinder 184. Air supply to both chambers of the double acting air cylinder 184 is controlled by an electromagnetic valve 186, which is controlled by an electric signal in accordance with the position of an operating lever of the weaving machine. Thus, the reversing lever 159 is moved in accordance with the movement of the operating lever of the loom. There is provided a proximity switch 187 for detecting an middle position of the piston of the double acting air cylinder 184. The idle position of the stepless speed change transmission can be obtained by detecting the piston of the double acting air cylinder 184 in the middle position and controlling the solenoid valve 186.

Thus, the stepless speed change transmission may be of a reversible type.

Figure 14:
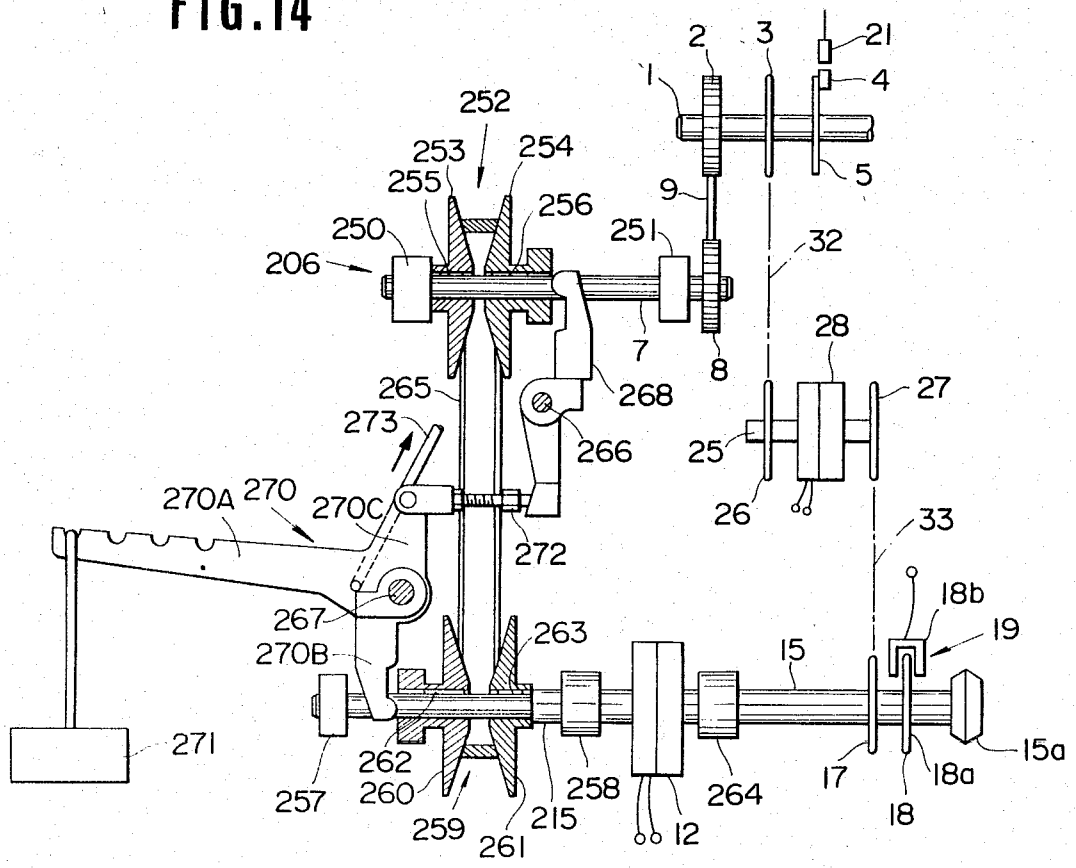
FIG. 14 is a schematic illustration of another speed change transmission.

Another example of the stepless speed change transmission 206 is shown in FIG. 14. This transmission is usually called Hunt lef-off motion. An input shaft 7 is supported by bearings 250 and 251. A first variable speed pulley 252 has a pair of cone members 253 and 254 mounted on the input shaft 7. Keys 255 and 256 prevent relative rotation between the cone members 253, 254 and the input shaft 7 but allows the cone members 253, 254 to slide axially. An output shaft 215 is supported by bearings 257 and 258. A second variable speed pulley 259 has a pair of cone members 260 and 261 mounted on the output shaft 215. Keys 262 and 263 prevent relative rotation between the output shaft 215 and the cone members 260 and 261, but allows the cone members 260 and 261 to slide axially. A reference numeral 264 denotes a bearing for supporting an output shaft 15. The first and second pulleys 252 and 259 are drivingly connected together by a belt 265. A two-arm lever 268 is centrally pivoted on a fixed shaft 266. One arm of the two-arm lever 268 pushes one end of the cone member 254. A three-arm lever 270 is pivoted at the center on a fixed shaft 267. A weight member 271 is suspended from a first arm 270A of the three-arm lever 270. A second arm 270B of the three-arm lever 270 pushes one end of the cone member 260 of the second pulley 259. A third arm 270C of the three-arm lever 270 is connected by a rod 272 to a second arm of the two-arm lever 268. The three-arm lever 270 is pulled through a rope 273 by warp tension detecting means in a direction shown by an arrow in FIG. 14. That is, the three-arm lever 270 is biased toward such a direction as to rotate in a clockwise direction. The three-arm lever 270 is normally in a normal equilibrium position in which a moment exerted by the warp tension detecting means through the rope 273 counterbalances a moment exerted by the weight member 271. In this state, the cone member 254 of the first pulley 252 is held in a position determined by the balance between a push of the arm of the two-arm lever 268 and the tension of the belt 265. The cone member 260 is held in a position determined by the balance between the tension of the belt 265 and a push of the second arm 270B of the three-arm lever 270. Thus, torque is transmitted at the gear ratio determined by the positions of the corn members 254 and 260.

If the warp tension increases, the rope 273 is pulled by the warp tension detecting means. Consequently, the three-arm lever 270 is rotated in the clockwise direction and moves the cone member 254 toward the cone member 253 and the cone member 260 away from the cone member 261 until the balance is established again. Thus, the diameter of the first pulley 252 is increased, and the diameter of the second pulley 259 is decreased. In this way, this stepless speed change transmission increases the rotational speed of the warp beam by increasing the gear ratio in accordance with an increase of the warp tension, and maintains the warp tension at a predetermined level. If the warp tension decreases, the stepless speed change transmission decreases the diameter of the first pulley 252 and increases the diameter of the second pulley 259 so that the rotational speed of the warp beam is decreased to maintain the warp tension at the predetermined level.

What is claimed is:

1. A weaving system comprising a warp beam, a main weaving mechanism, combined with said warp beam, for moving periodically so as to repeat a weaving cycle, said main mechanism being capable of operating alternately in a normal weaving operation mode and a slow operation mode, a driving shaft which is driven in synchronism with the periodical movement of said main mechanism, first drive means for driving said warp beam in said normal operation mode by transmitting power from said driving shaft, said first drive means including speed change means capable of changing the speed of the warp beam rotation, said first drive means including first clutch means for connecting and disconnecting the driving connection between said driving shaft and said warp beam through said first drive means, second drive means for driving said warp beam in said slow operation mode by transmitting power from said driving shaft, said second drive means including second clutch means for connecting and disconnecting the driving connection between said driving shaft and said warp beam through said second drive means, first sensing means for sensing the periodical movement of said main mechanism, second sensing means for sensing the rotational movement of said warp beam, and control means connected with said first and second sensing means, for determining, during said normal operation mode, a quantity indicative of an angular displacement of said warp beam per weaving cycle in accordance with signals produced by said first and second sensing means, storing the determined value of said quantity, and controlling the warp beam rotation during said slow operation mode by controlling said second clutch means in such a manner that said warp beam rotates only through an angle equal to the stored value when said main mechanism is moved through one weaving cycle during said slow operation mode.

2. A weaving system according to claim 1, wherein said control means determines said quantity each time said main mechanism completes a first predetermined number of the weaving cycles during said normal operation mode, said quantity determined by said control means at the end of each interval being equal to a quotient obtained by dividing an angular displacement through which said warp beam rotates during that interval, by a second predetermined number, and wherein said control means stores the newest value of the periodically determined quantity.

3. A weaving system according to claim 2, wherein said second drive means causes said warp beam to rotate in a forward direction when said main mechanism moves in a forward direction to complete the weaving operation, and in a reverse direction when said main mechanism moves in a reverse direction.

4. A weaving system according to claim 3, wherein said speed change means changes the speed of the warp beam rotation in accordance with warp tension.

5. A weaving system according to claim 4, wherein said first predetermined number is a positive integer, and said second predetermined number is a positive integer.

6. A weaving system according to claim 5, wherein said first predetermined number is equal to said second predetermined number.

7. A weaving system according to claim 5, wherein said control means in capable of changing said first and second predetermined numbers.

8. A weaving system according to claim 5, wherein said first sensing means produces a first pulse each time said main mechanism moves through one weaving cycle, and said second sensing means produces a second pulse each time said warp beam rotates through a predetermined angle, and wherein said control means comprises switching means connected with said first sensing means, and counting means connected with said second sensing means, said counting means being for counting the number of said second pulses which said counting means receives, said switching means being for resetting said counting means to zero upon each receipt of said first pulse, said quantity being the count of said counting means.

9. A weaving system according to claim 8, wherein said control means further comprises storage means connected with said counting means and said switching means, said switching means commanding said counting means to transfer the current count to said storage means before said counting means is reset, upon each receipt of said first pulse, said switching means commanding said storage means to replace the content by the count transfered by said counting means upon each receipt of said first pulse during said normal operation mode, said switching means prohibiting said storage means from changing the content during said slow operation mode.

10. A weaving system according to claim 9, wherein said control means further comprises comparing means, connected with said counting means and said storage means, for comparing the count of said counting means with the content of said storage means, and actuating means, connected with said switching means and said comparing means, for actuating said second clutch means, said actuating means having an operative state in which said actuating means connects said second clutch means and allows said second drive means to drive said warp beam, and an inoperative state in which said actuating means disconnects said second clutch means and prevents said second drive means from driving said warp beam, said switching means bringing said actuating means to said operative state upon each receipt of said first pulse, said comparing means bringing said actuating means to said inoperative state each time the count of said counting means reaches the content of said storage means, said comparing means being connected with said switching means and reset by said switching means to an initial state for starting the comparison each time said switching means receives said first pulse.

11. A weaving system according to claim 10, wherein said control means further comprises first divider means connected between said first sensing means and said switching means, and second divider means connected between said second sensing means and said counting means, being for said first divider means admitting only one of said first pulses into said switching means each time said first divider means receives said first predetermined number of said first pulses from said first sensing means, and said second divider means being for admitting only one of said second pulses into said counting means each time said second divider means receives said second predetermined number of said second pulses from said second sensing means, said first and second divider means allowing free passage of pulses therethrough during said slow operation mode.

12. A weaving system according to claim 11, wherein said first and second divider means are capable of changing said first and second predetermined numbers, respectively.

13. A weaving system according to claim 4, wherein said speed change means comprises;

means for sensing warp tension, an input shaft driven by said driving shaft, an output shaft for driving said warp beam, transmitting means, connected between said input shaft and said output shaft, for transmitting power from said input shaft to said output shaft, said transmitting means comprising an eccentric, a connecting rod, a driven ring and one-way clutch means, said eccentric having an inner member through which said input shaft is keyed eccentrically and an outer member mounted on said inner member and rotatable round the rim of said inner member for causing said connecting rod to reciprocate rectilinearly, said connecting rod having a first end pivotally connected with said outer member of said eccentric, and a second end pivotally connected with said driven ring, said driven ring being mounted on said output shaft through said one-way clutch means and being caused to rotate back and forth by the reciprocating movement of said connecting rod, said one-way clutch means being for transmitting the movement of said driven ring to said output shaft in a prescribed manner, regulating means, connected with said warp tension sensing means and said outer member of said eccentric, for changing the stroke of the reciprocating movement of said connecting rod by controlling the movement of said outer member in accordance with warp tension sensed by said warp tension sensing means.

14. A weaving system according to claim 13, wherein said speed change means comprises a plurality of said transmitting means which moves periodically with a phase difference from each other by being driven by said input shaft, for driving said output shaft.

15. A weaving system according to claim 14, wherein said regulating means comprises a common shaft which is movable so that it remains generally in parallel with said input shaft, link means, connected between said warp tension sensing means and said common shaft, for moving said common shaft relative to said input shaft in accordance with warp tension sensed by said warp tension sensing means, and a plurality of control arms each of which has a first end mounted on said common shaft and a second end pivotally connected with one of said outer members of said eccentrics, each of said control arms being swingable on said common shaft.

16. A weaving system according to claim 15, wherein said one-way clutch means of each transmitting means comprises a plurality of rollers and arc members placed alternately in an annular space formed between a cylindrical inner surface of said driven ring and said output shaft, and springs disposed between each neighboring pair of said roller and said arc member, each of said arc members being slidable circumferentially in said annular space, each of said rollers being received in a recess which is formed in said output shaft and has a first portion, a middle portion and a second portion arranged circumferentially, each of said rollers being wedged between the inner surface of said driven ring and said output shaft when said roller is in said first portion and said driven ring rotates in a first direction, and when said roller is in said second portion and said driven ring rotates in a second direction opposite to said first direction, each of said driven rings being capable of rotating back and forth freely without driving said output shaft when each of said rollers is in said middle portion.

17. A weaving system according to claim 16, wherein said speed change means further comprises shift means which includes ring means, a shift rod and shifter means, said ring means being rotatably mounted on said output shaft and fixedly connected with said arc members of said one-way clutch means so that all of said arc members are rotatable, relative to said output shaft, integrally with said ring means, said shift rod being received in an axially extending bore centrally formed in said output shaft, said shift rod being axially slidable in said axially extending bore, said shift rod having a radially extending pin, said pin passing radially through an axial slot formed in said output shaft and through a slant slot formed in said ring means, said axial slot of said output shaft being axially elongated and allowing said shift rod to move axially by allowing said pin to slide axially in said axial slot, said slant slot being elongated in a slant direction inclined with respect to the axial direction of said output shaft and allowing said pin to slide along said slant direction, said pin sliding along said slant direction in said slant slot and by so doing causing said ring member to rotate relative to said output shaft when said pin moves axially in said axial slot, said shifter means being capable of changing the axial position of said shift rod.

18. A weaving system according to claim 17, wherein said shift rod has a first axial position, a middle axial position and a second axial position, said rollers being held in said first portion by said arc members when said shift rod is in said first axial position, said rollers being held in said middle portion by said arc members when said shift rod is in said middle position, said rollers being held in said second portion by said arc members when said shift rod is in said second position.

19. A weaving system according to claim 4, wherein said speed change means comprises belt drive means including a first variable pitch pulley mounted on an input shaft driven by said driving shaft and a second variable pitch pulley mounted on an output shaft for driving said warp beam, and drivingly connected with said first variable pulley by a belt, means for sensing warp tension, and regulating means, connected with said warp sensing means for changing the pulley diameters of said first and second variable pitch pulleys in accordance with warp tension sensed by said warp tension sensing means.

20. A weaving system according to claim 19, wherein each of said first and second pulleys has two halves which can be moved farther apart or closer together so as to change the transmission ratio of the belt drive means, by said regulating means.

* * * * *